US005581881A

United States Patent [19]

Sherman et al.

[11] Patent Number: 5,581,881

[45] Date of Patent: Dec. 10, 1996

[54] METHOD OF MAKING A CYLINDER BARREL HAVING CERAMIC BORE LINERS

[75] Inventors: Donald H. Sherman, Morton; Michael C. Long, Peoria, both of Ill.

[73] Assignee: Caterpillar Inc., Peoria, Ill.

[21] Appl. No.: 323,645

[22] Filed: Oct. 17, 1994

[51] Int. Cl.[6] ..... B22D 19/00

[52] U.S. Cl. ..... 29/888.061; 29/888.02; 91/499; 164/98

[58] Field of Search ..... 29/888.02, 888.061, 29/527.5; 164/98, 100; 92/169.1; 91/499

[56] References Cited

U.S. PATENT DOCUMENTS

| | | | |
|---|---|---|---|
| 3,550,233 | 12/1970 | Rubery et al. | 29/156.4 |
| 3,568,723 | 3/1971 | Sowards | 164/98 X |
| 3,709,108 | 1/1973 | Alger, Jr. et al. | 92/169 |
| 3,863,701 | 2/1975 | Niimi et al. | 164/98 |
| 4,426,914 | 1/1984 | Kline | 91/487 |

FOREIGN PATENT DOCUMENTS

| | | | |
|---|---|---|---|
| 60-115358 | 6/1985 | Japan | 164/98 |
| 61-165263 | 7/1986 | Japan | 164/98 |

*Primary Examiner*—S. Thomas Hughes
*Attorney, Agent, or Firm*—John W. Grant

[57] ABSTRACT

A cylinder barrel includes a casting having a plurality of ceramic bore liners cast in situ within the casting. The cylinder barrel is made by positioning the ceramic bore liners at predetermined locations within a casting mold and pouring a molten ferrous metal into the mold so as to envelope the bore liners.

2 Claims, 1 Drawing Sheet

METHOD OF MAKING A CYLINDER BARREL HAVING CERAMIC BORE LINERS

TECHNICAL FIELD

This invention relates generally to rotary cylinder barrels for axial piston hydraulic pumps or motors and more particularly to a cylinder barrel made from ferrous metal and having ceramic bore liners, and a method of making the cylinder barrel.

BACKGROUND ART

The rotary cylinder barrels of axial piston hydraulic pumps or motors are commonly made of cast iron or steel to withstand the forces generated in today's high pressure units. The pistons of such units are normally made of steel and many of such cylinder barrels use cylinder bore liners made of a metal different from the remainder of the rest of the barrel to prevent piston galling and seizure during operation.

Heretofore, the cylinder liners have typically been made from a metal such as bronze or a bronze alloy. The method of making those cylinder barrels generally included machining oversized bores within the barrel and either mechanically, chemically or metallurgically bonding the cylinder liners within the bores. The size relationship of the bore and the bore liner is extremely critical thereby requiring precision machining processes to ensure proper fit up. Such precision machining adds significantly to the overall cost of making the cylinder barrel. Additionally, such bronze liners are inherently softer than the steel pistons which reciprocate therein and are somewhat prone to wear and scuffing.

In view of the above, it would be desirable to have a cylinder barrel which is more economical to manufacture and in which the bore liners are made from a nonmetallic material which is more resistant to wear and scuffing than the heretofore known metal bore liners.

The present invention is directed to overcoming one or more of the problems as discussed above.

DISCLOSURE OF THE INVENTION

In one aspect of the present invention, a cylinder barrel for an axial piston unit comprises a ferrous metal casting and a plurality of ceramic sleeves cast in situ within the casting.

In another aspect of the present invention, a method of making a cylinder barrel for an axial piston unit in which the cylinder barrel has a plurality of circumferentially spaced bores comprises the steps of positioning a plurality of elongate bore liners made from a ceramic material at predetermined locations within a casting mold having the basic shape of the cylinder barrel, blocking entry into the central opening of the bore liners and pouring a molten ferrous metal into the mold and enveloping the bore liners so that the bore liners become an integral part of the casting when the molten ferrous metal solidifies.

BEST MODE FOR CARRYING OUT THE INVENTION

Figure 1:
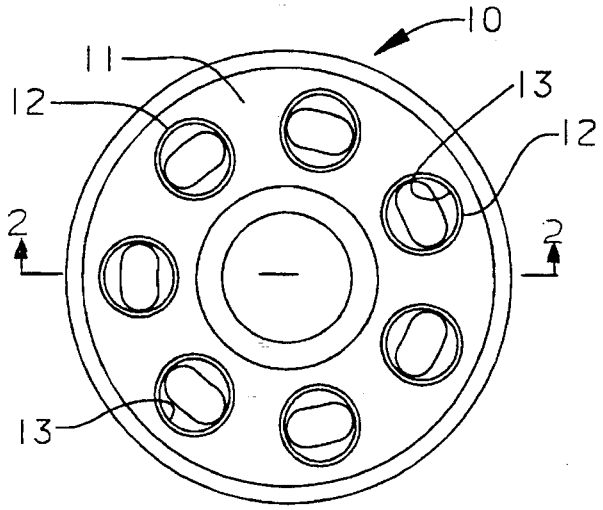
FIG. 1 is a bottom plan view of a cylinder barrel embodying the present invention.
Figure 2:
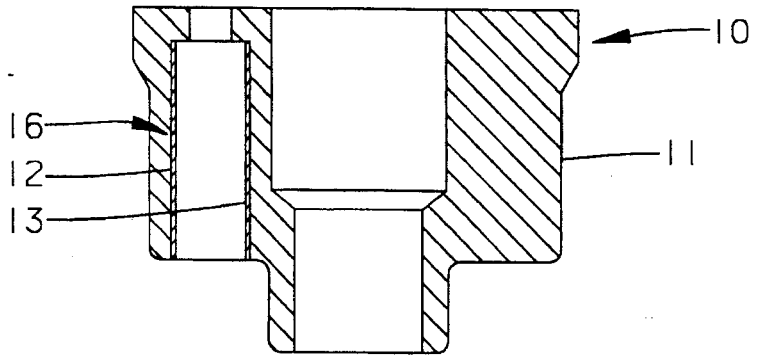
FIG. 2 is a sectional view taken along line 2—2 of FIG. 1.

Referring to FIGS. 1 and 2, a cylinder barrel 10 for an axial piston unit includes a ferrous metal casting 11 and a plurality of elongate circumferentially arranged cylindrical ceramic bore liners 12 cast in place within the casting. Each of the bore liners defines a bore 13 which in use reciprocatably receives a piston, not shown. The ceramic material used for making the bore liners of this embodiment can be, for example silicon nitride, silicon carbide or other ceramics capable of withstanding high compressive stress.

Figure 3:
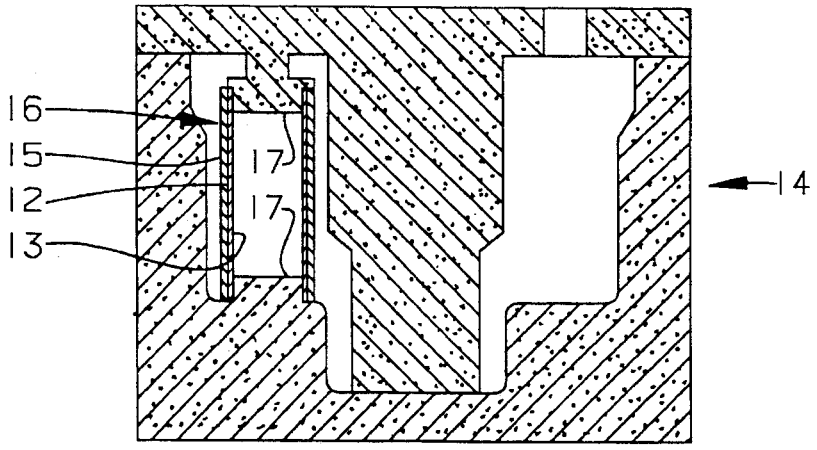
FIG. 3 is a sectional view taken through a casting mold for use in the method of the present embodiment.

FIG. 3 is a diagrammatic representation of a multi-piece casting mold 14 for carrying out the method steps of making the cylinder barrel shown in FIGS. 1 and 2. One of the bore liners 12 is shown positioned at a predetermined location prior to forming the casting. The bore liner is encompassed within a ferrous metal sleeve 15 which provides an interface between the bore liner and the casting 11 to reduce stresses in the casting. The metal sleeve is made from ferrous metal having essentially the same composition as the casting. A lock device 16 is provided to mechanically lock the bore liner to the metal sleeve. The lock device 16 can be, for example, protrusions, lugs, indentions or the like which forms irregular surfaces at the interface between the bore liner and the sleeve. The outer surface of the sleeve can also be corrugated to aid in keying the sleeve and hence the bore liner to the casting. The mold diagrammatically illustrates a pair of plugs 17 extending into the bore 13 to block entry into the bore. The mold has a cavity defining the basic shape of the cylinder barrel.

The method steps of making the cylinder barrel 10 includes the steps of positioning the plurality of ceramic bore liners 12 at predetermined locations within the casting mold 14, blocking entry into the bore of the bore liners and pouring a molten ferrous metal into the mold to envelope the bore liners so that they become a integral part of the casting when the molten ferrous metal solidifies. The method further includes the steps of encompassing each of the ceramic bore liners within a ferrous metal sleeve 15 prior to positioning the bore liners within the casting mold and providing an irregular surface at the interface between the bore liners and the metal sleeves. The thickness of the metal sleeves is selected so that the sleeves are not completely melted by the molten metal poured into the casting mold. The ferrous metal employed in this embodiment can be, for example, either cast iron or steel.

INDUSTRIAL APPLICABILITY

The advantages of making cylinder barrels in the manner described above is that even though ceramics in general have low fatigue strength in tension, high compressive stresses are developed in the ceramic bore liners as the molten ferrous metal solidifies. In use, such high compressive stresses prevent the high internal fluid pressures from inducing tensile stresses in the ceramic bore liners. Another advantage is that the casting process tends to lock the sleeves in place in the barrel. Finally, this method provides a less expensive cylinder barrel since many of the precision machining operations are eliminated.

Other aspects, objects and advantages of this invention can be obtained from a study of the drawings, the disclosure and the appended claims.

We claim:

1. A method of making a cylinder barrel for an axial piston unit in which the cylinder barrel has a plurality of circumferentially spaced bores each adapted to reciprocatably receive a piston of the axial piston unit comprising the steps of;

positioning a plurality of elongate cylindrical bore liners made from a ceramic material at predetermined locations within a casting mold having the basic shape of the cylinder barrel;

encompassing each of the bore liners within a ferrous metal sleeve prior to positioning the bore liner within the mold;

blocking entry into the bores of the bore liners; and pouring a molten ferrous metal into the mold enveloping the bore liners so that the bore liners become an integral part of the casting when the molten ferrous metal solidifies.

2. The method of making a cylinder barrel as set forth in claim 1 including the step of providing an irregular surface at the interface between the bore liner and the metal sleeve.

* * * * *